United States Patent [19]

Skala

[11] 4,271,673

[45] Jun. 9, 1981

[54] STEAM TURBINE PLANT

[75] Inventor: Karel Skala, Windisch, Switzerland

[73] Assignee: BBC Brown, Boveri & Company, Limited, Baden, Switzerland

[21] Appl. No.: 12,449

[22] Filed: Feb. 15, 1979

[30] Foreign Application Priority Data

Feb. 21, 1978 [CH] Switzerland ..... 1840/78

[51] Int. Cl.[3] ..... F01K 13/02

[52] U.S. Cl. ..... 60/660; 60/664; 60/644

[58] Field of Search ..... 60/646, 657, 660, 664, 60/665, 667, 644

[56] References Cited

U.S. PATENT DOCUMENTS 3,934,419 1/1976 Aanstad ..... 60/660

FOREIGN PATENT DOCUMENTS 718179 9/1965 Canada ..... 60/660

*Primary Examiner*—Allen M. Ostrager

*Attorney, Agent, or Firm*—Burns, Doane, Swecker & Mathis

[57] ABSTRACT

A system for regulating the rate of closing of the turbine intake valve of a steam turbine plant is disclosed. A steam turbine is supplied from a steam generator through a turbine intake valve. A branch line conducts the steam to a bypass valve which is normally closed. In the event of conditions making it necessary to close the turbine intake valve rapidly, a regulator is provided to control the rate of closing of the turbine intake valve and the opening of the bypass valve so that the pressure conditions in the steam generator do not exceed the limits established by the manufacturer. Pressure measuring instruments are placed in the system to sense the pressure immediately upstream from the turbine intake valve and the bypass valve as well as the initial steam supply pressure. These pressure signals are transmitted to a computer which produces a control signal in accordance with predetermined conditions.

3 Claims, 5 Drawing Figures

STEAM TURBINE PLANT

BACKGROUND OF THE INVENTION

This invention relates to steam turbine plants and more particularly to systems for regulating the flow of steam to turbines.

It is known that the supply of steam to a turbine in a steam turbine plant may be regulated by installing a pressure measuring instrument on the upstream side of the turbine intake valve. In the event of a rapid reduction in the power required from the turbine, for example in the case of a short circuit or stroke of lightening in one section of the power network, the turbine intake valves close and bypass valves open rapidly. As a result, considerable changes in steam pressure will occur upstream from the valves. These changes in steam pressure will advance along the line at substantially identical velocities in the direction of the source of the steam. Especially large pressure variations are found immediately in front of the turbine intake valve, which is where the pressure measuring instrument is typically located. When the steam is being generated by a nuclear power plant this arrangement will adversely influence the parameters established by the reactor manufacturer for the initial pressure control to such an extent that limits of the value:

$$FM = \int_0^t \frac{Q_{VE}(t) + Q_{BP}(t) - Q_{RE}(t)}{Q_{RE}(t)}\, dt$$

might be exceeded. In this formula, $Q_{VE}$ represents the flow through the turbine intake valve, $Q_{BP}$ represents the flow through the bypass valve and $Q_{RE}$ represents the flow from the reactor outlet aperture. These limiting values are not exceeded if the changes in opening and closing of the valves occurs relatively slowly. Very rapid changes in the position of the valves, which is desirable under ordinary circumstances, could not be utilized heretofore within the specific limits set for operation of nuclear power plants.

It is an object of this invention to provide a steam power plant in which these disadvantages are overcome, specifically wherein the turbine inlet and bypass valve are capable of changing position rapidly while still maintaining the limits established by the manufacturer of the reactor.

SUMMARY OF THE INVENTION

In accordance with this invention, a regulating circuit is provided to control the opening and closing of the turbine intake valve and the bypass valve. The regulating circuit includes a pressure measuring instrument in each branch line immediately upstream of the valve for measuring the pressure in the line and these pressures are sensed in a computer to provide an arithmetical mean value and then to determine the difference between the mean value and the desired pressure set point value and to utilize the differential value to operate the bypass valve to maintain the pressure in the steam generator at a constant value. In this manner, the operation of the turbine intake and bypass valves can occur rapidly while still maintaining the limits established by the manufacturer of the reactor.

DETAILED DESCRIPTION OF THE DRAWINGS

The invention is illustrated in accordance with several preferred embodiments in the accompanying drawings in which.

DESCRIPTION OF THE PREFERRED EMBODIMENTS

Figure 1:
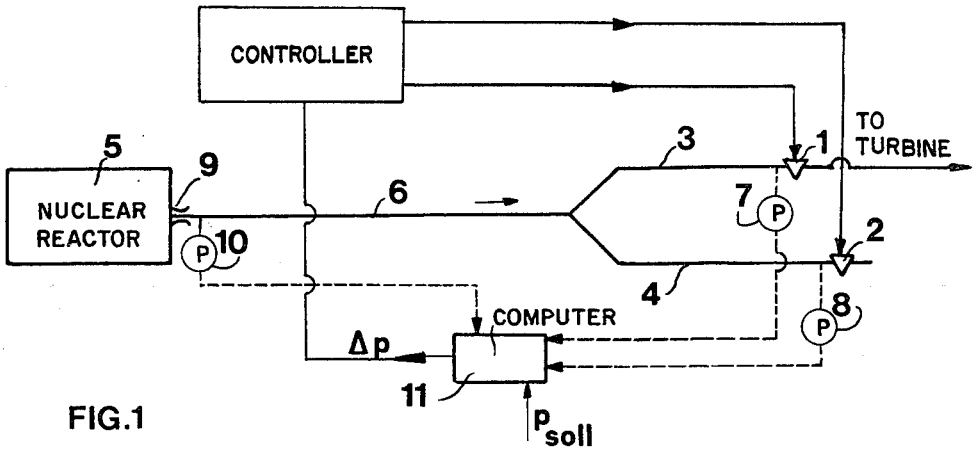
FIG. 1 is a schematic view of a nuclear power plant including a steam generating unit with the regulating system of this invention.

Referring to FIG. 1, a nuclear power plant 5 includes a source of live steam to be supplied to a turbine for power generation. Flow of steam to the turbine is controlled by a turbine intake valve 1 which is supplied through a supply line 6 and a branch pipeline 3 from the nuclear reactor 5. A branch line 4 supplies steam to a bypass valve 2. Directly upstream from the turbine intake valve 1 a pressure measuring device 7 measures the pressure in the line 3 and transmits the pressure value to a computer 11 through a suitable signal transmitting line. A pressure measuring instrument 8 is also located immediately upstream from the bypass valve 2 and a line is provided for transmitting the value sensed by the instrument 8 to the computer 11. Steam from the reactor 5 passes through a supply valve 9 into the supply line 6. A pressure measuring instrument 10 immediately downstream from the valve 9 measures the pressure and transmits a signal through a line to the computer 11. The computer is a conventional device which is programmed to solve the following equation:

$$\Delta p = \frac{p_1 \cdot G_1 + [p_2 - (p_2' - p_1')] \cdot G_2 + [p_3 - (p_3' - p_1')] \cdot G_3}{G_1 + G_2 + G_3} - p_{pressure\ set\ point}$$

where $p_1$ represents the pressure upstream from the intake valve 1, $p_2$ represents the pressure immediately upstream from the bypass valve 2, $p_3$ represents the pressure at the outlet of the valve 9, $G_1$ represents the weight factor of pressure $p_1$, $G_2$ represents the weight factor of pressure $p_2$, $G_3$ represents the weight factor of pressure $p_3$; $p'_1$ represents the pressure during steady state operation of the pressure immediately in front of the turbine intake valve 1, $p'_2$ represents the pressure immediately upstream from the bypass valve 2 during steady state operation and $p'_3$ represents the pressure at the outlet 9 of the reactor 5 during steady state operation. Thus the signal $\Delta p$ is the difference between the arithmetical mean of the sensed pressure and a pressure set point. The signal $\Delta p$ produced by the computer 11 is applied to a controller 18 which controls the operation of the intake valve 1 and the bypass valve 2 in response to the signal Δp.

As a specific example of the system in accordance with this invention, the branch line 3 has a length of 25 meters, the branch pipeline 4 has a length of 35 meters and the supply line 6 has a length of 80 meters. During steady state operation, the signal Δp produced by the computer 11 is applied only to adjust the position of the turbine intake valve 1 because the bypass valve 2 remains closed. As long as the value of Δp does not exceed the maximum value established by the reactor manufacturer, it is possible to eliminate, or at least reduce to an insignificant magnitude, the undesirable pressure fluctuations which previously occurred in steam supply systems of the prior art.

When a rapid power reduction is required, for example in the case of a short circuit in the electrical system which is supplied by the generator driven by the turbine, the turbine intake valve is moved as rapidly as possible in a closing direction. The bypass valve 2 is controlled by means of the signal Δp for the purpose of keeping the pressure in the live steam generator at a constant level, or within the limits established by the reactor manufacturer. If it is found that the precise determination of the signal Δp is not essential, an approximation may be used as follows:

$$\Delta p = \frac{p_1 \cdot G_1 + p_2 \cdot G_2 + p_3 \cdot G_3}{G_1 + G_2 + G_3} - p_{pressure\ set\ point}$$

or still less precisely by $$\Delta p = \frac{\sum_1^n p_i}{n} - p_{pressure\ set\ point} = \frac{p_1 + p_2 + p_3}{3} - p_{pressure\ set\ point}$$

Figure 2:
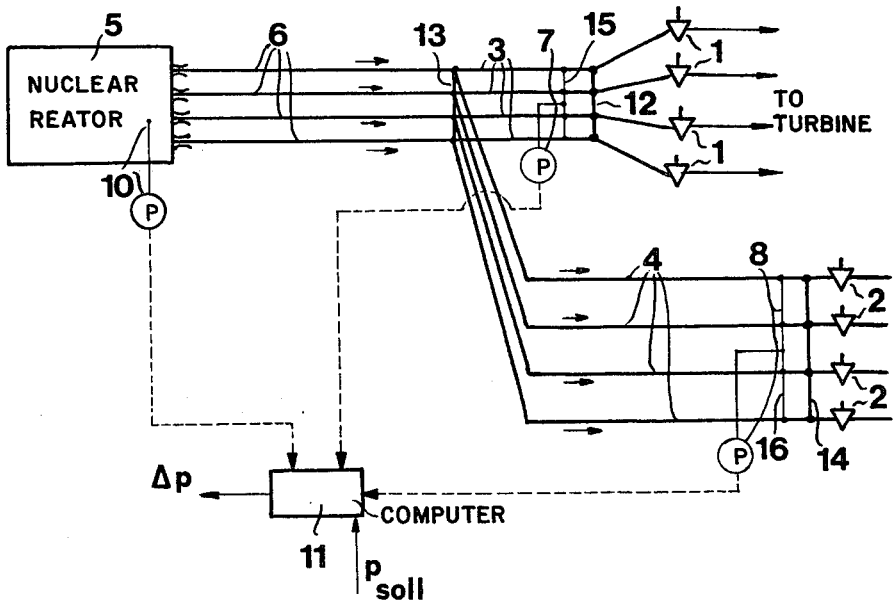
FIG. 2 is a schematic view of another embodiment of the nuclear power plant as in FIG. 1, but including multiple branch lines.

The embodiment shown in FIG. 2 differs from that of FIG. 1 principally only in the arrangement of the steam lines 3, 4 and 6. FIG. 2 illustrates the usual installation wherein a plurality of individual lines supply steam to a plurality of turbine intake valves 1. Each of the individual supply lines is interconnected by cross pipes 12, 13 and 14 for the purpose of equalizing the pressure in the pipes. The pressure to be measured in front of the turbine intake valves 1 is sensed by a common tap 15 which is connected across all of the branch pipelines 3. Similarly, the pressure to be measured upstream from the bypass valves 2 is sensed by a common tap 16 which is connected across all of the pipelines 4. The third pressure measuring instrument 10 is located in the steam manifold of the reactor 5, and not at the outlet, as in FIG. 1. Of course, as an alternative, individual pressure measuring instruments could be connected with each of the respective pipelines 3, 4 and 6 if it is desired to increase the accuracy of the resulting signal Δp. The operation of the system shown in FIG. 2 is essentially the same as that previously described with respect to FIG. 1.

Figure 3:
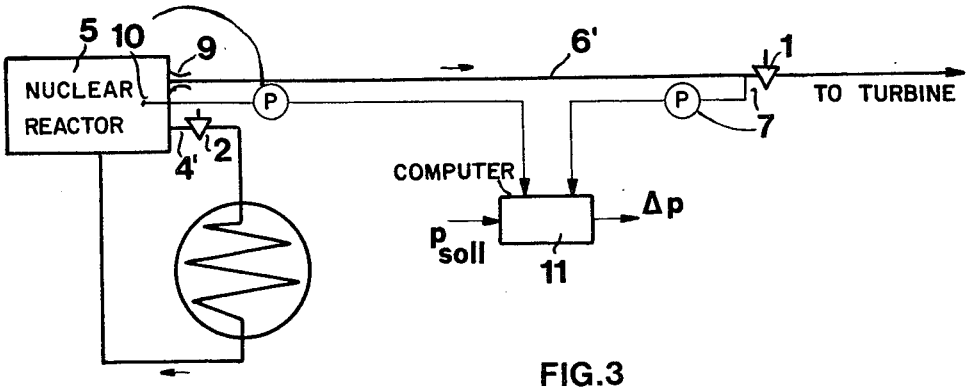
FIG. 3 is a schematic view of a nuclear power plant wherein the bypass valve is located immediately adjacent the steam generator.

Referring to FIG. 3, the turbine intake valve 1 and the bypass valve 2 are connected with the steam manifold of the reactor 5 by separate lines 6' and 4' respectively. The pipeline 4' is so short that its pressure difference relative to the pressure measured in the steam manifold of the reactor 5 is negligible. Therefore, a single pressure measuring instrument 10 is located within the steam manifold of the reactor 5 as a substitute for the separate instruments 8 and 10 of FIG. 1. A conventional condensor and return line for the steam flowing through the bypass valve 2 are also illustrated in FIG. 3.

Figure 4:
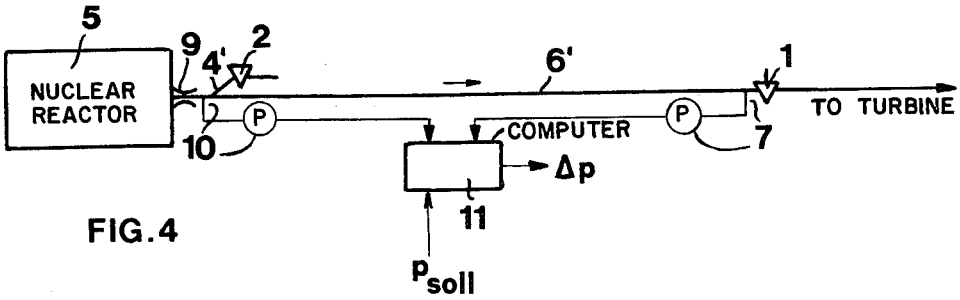
FIG. 4 is a schematic view of another embodiment of the apparatus of this invention in which the bypass valve is located immediately adjacent the outlet of the steam generating unit.

In the embodiment of FIG. 4, the bypass valve 2 is connected by a very short pipeline 4' with the main pipeline 6' immediately downstream from the supply line 9 of the reactor 5. Therefore, the pressure measuring instrument 10 which is connected at the junction of the supply line 6' and the pipeline 4' is utilized to measure essentially the pressure immediately upstream from the bypass valve 2 as well as the supply line 6' since the difference in pressure readings from measuring these pressures separately would be negligible.

Figure 5:
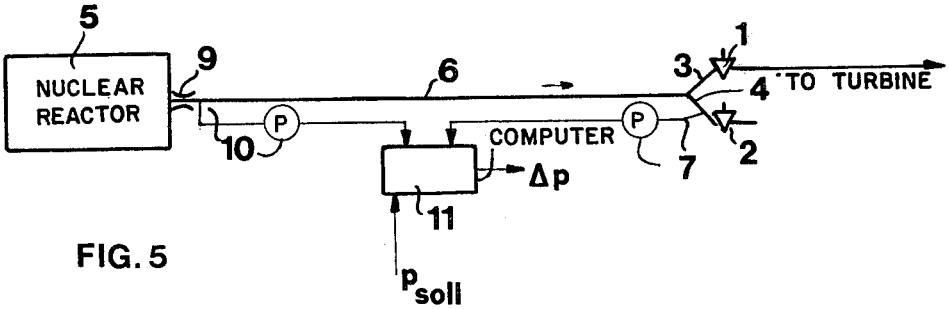
FIG. 5 is a schematic view of a steam generating unit as in FIG. 4, but having the bypass valve and turbine intake valve located in close proximity to each other.

In the embodiment of FIG. 5, the branch pipelines 3 and 4 are of such short length that a single pressure measuring instrument 7 may be used for measuring the pressure immediately upstream from both the turbine intake valve 1 and the bypass valve 2. Of course, in the alternative, the pressure measuring instrument 7 of FIG. 5 may be placed in the pipeline 3 instead of the line 4, since both of these pipelines are at substantially the same pressure.

In each of the embodiments of FIGS. 3, 4 and 5, the control of the turbine intake valve 1 and the bypass valve 2 is accomplished in the same manner as previously described with respect to the systems of FIGS. 1 and 2.

While this invention has been illustrated and described in accordance with a preferred embodiment and modifications, it is recognized that variations and changes may be made therein without departing from the invention as set forth in the claims.

What is claimed is:

1. A steam supply system for a steam turbine plant of the type having a turbine intake valve and a bypass valve to control the flow of steam from a steam generator, said system comprising:

(a) means for sensing steam pressure on the upstream side of said turbine intake valve;

(b) means for sensing steam pressure on the upstream side of said bypass valve;

(c) means for sensing steam pressure at said steam generator; and (d) regulator means for controlling the operation of said valves in response to the difference between the arithmetical mean of said sensed pressures and a pressure set point.

2. The steam supply system as defined in claim 1 wherein said steam supply system includes a supply pipe, a first branch pipeline connecting said supply line and said turbine intake valve and a second branch pipeline connecting said supply line and said bypass valve, said pressure means being connected with the respective branch pipelines adjacent said valves.

3. The system as defined in claim 1 including a plurality of turbine intake valves and a plurality of bypass valves, each of said intake valves being connected with a steam supply line through a branch pipeline, each of said bypass valves being connected with a steam supply line by a branch pipeline, a crossover pipe interconnecting said bypass branch lines of said intake valve and a crossover pipe interconnecting the pipelines of said bypass valve, whereby steam flows through separate supply lines and branch lines and pressure between lines is equalized through said crossover pipes.

* * * * *